United States Patent [19]

Dunkerly, II et al.

[11] 4,264,290

[45] Apr. 28, 1981

[54] FIBER VELOCITY IMPARTER DEVICE FOR DRY-FORMING SYSTEMS

[75] Inventors: Cedric A. Dunkerly, II, Appleton, Wis.; Sheila E. Widnall, Lexington, Mass.

[73] Assignee: American Can Company, Greenwich, Conn.

[21] Appl. No.: 89,926

[22] Filed: Oct. 31, 1979

[51] Int. Cl.[3] ..... B29C 13/00

[52] U.S. Cl. ..... 425/83.1; 264/121

[58] Field of Search ..... 425/83.1; 264/121

[56] References Cited

U.S. PATENT DOCUMENTS

| | | | |
|---|---|---|---|
| 2,969,104 | 1/1961 | Schubert et al. | 264/121 |
| 3,834,869 | 9/1974 | Ancelle et al. | 264/121 |
| 4,081,501 | 3/1978 | Muther | 264/121 |

*Primary Examiner*—Donald E. Czaja
*Assistant Examiner*—James R. Hall
*Attorney, Agent, or Firm*—Robert P. Auber; George P. Ziehmer; Paul R. Audet

[57] ABSTRACT

A device having at least one, preferably a plurality of air turning foils situated upstream of and at the level of the region between a fiber distributor and an underlying moving forming surface. Terminal edge portions of the foils direct ambient air in the direction of forming surface movement to impart to fibers in transit between the distributor and forming wire a uniform velocity component of movement in said direction. Each foil preferably is convex from upstream of the foil when viewed in cross section, is parallel to and equidistant from the other, and has its terminal edge portion parallel to the forming surface.

28 Claims, 9 Drawing Figures

FIG.1
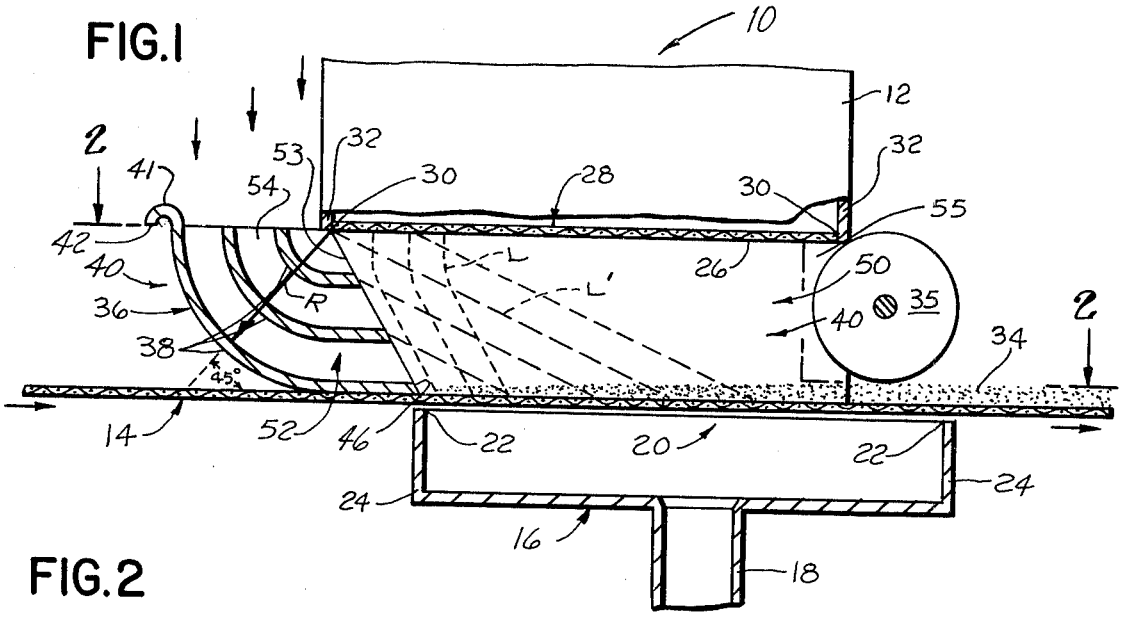
FIG.2
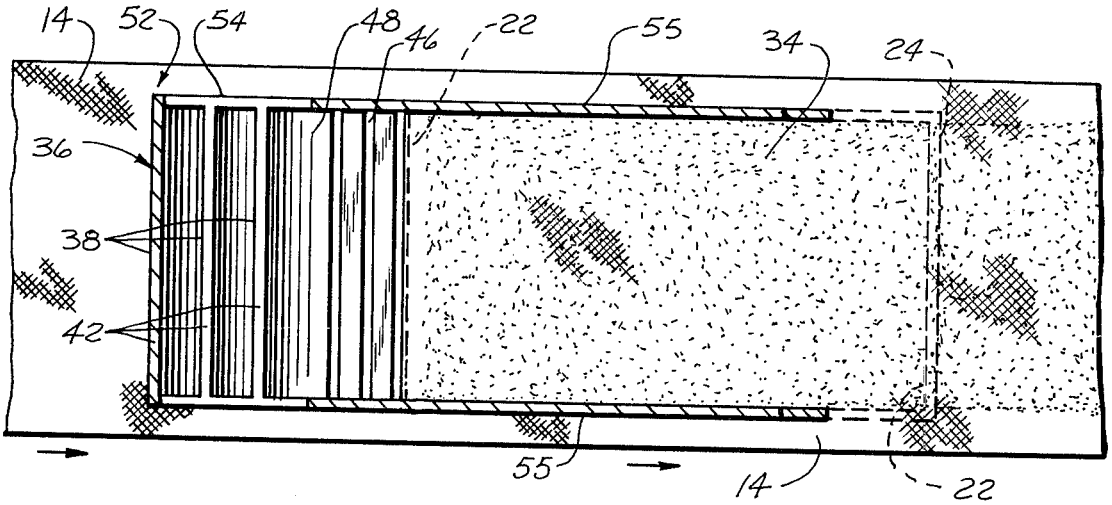
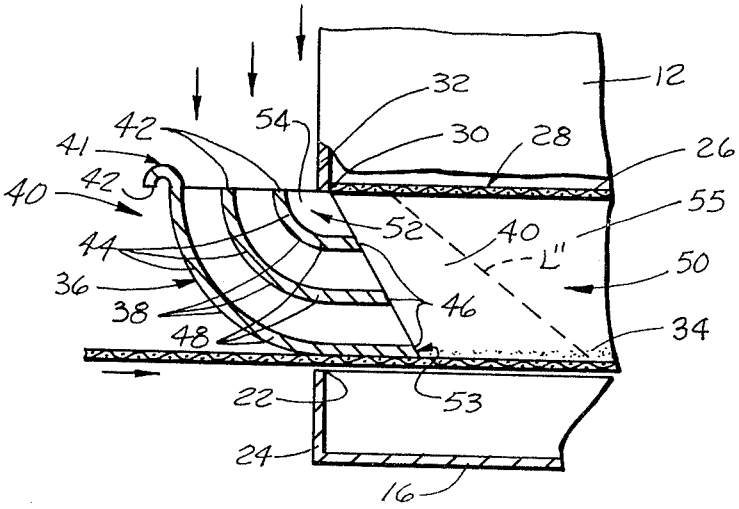
FIG.3

FIBER VELOCITY IMPARTER DEVICE FOR DRY-FORMING SYSTEMS

BACKGROUND OF THE INVENTION

This invention relates to apparatus for dry-forming fibrous webs. More particularly, it relates to apparatus for imparting a velocity component of movement in the direction of movement of a fiber continuum or web forming surface, to fibers as they transit in a gaseous medium, such as air, the region between a fiber distributor and the moving forming surface.

In systems for dry-forming fibrous materials, such as those for dry-laying fibers, filaments, and particulate matter onto a moving forming surface, it has been difficult to dry-lay the fibrous material uniformly onto the moving surface and form acceptable web products, particularly at commercial speeds of or above about 500 and 600 ft./min.. At such speeds, fiber lay-down is inconsistent or uneven in the machine direction. Side cross sectional profiles of such dry-laid loose fiber continuums and webs show that their upper surfaces have an undulating, wave-like or rippled appearance. When viewed from above, the appearance is commercially unacceptable. The differences in web density of the wave peaks and troughs appear as striations running in the cross machine direction. The troughs are thin or transparent and they often result in unacceptable tensile strengths and breakage during production and use.

In a typical dry-forming systems, fibers are distributed from the mouth of an apparatus which includes a distributor spatially vertically juxtaposed over a forming surface having thereunder a suction box. The fibers normally drop mostly vertically onto the forming surface, usually a foraminous surface such as a wire. At high speeds the fibers distribute themselves unevenly upon contact with the moving surface and tend to form fibrous lumps and clumps which in turn create the unacceptable undulating, striated, dry-laid continuum or web surface. Attempts to prevent non-uniform fiber distribution at high web speeds have included drawing air at a high velocity into the suction box under the forming wire, to pull the fibers onto and hold them in place on the moving wire. However, such attempts have resulted in the problem known as stapling, wherein the ends of the fibers are drawn through the wire openings in the screen. This renders it difficult to quickly and easily remove the deposited fibers from the wire.

It has been generally thought that web formation could be generally improved by giving the distributed fibers a velocity component of movement in the direction that the forming surface is moving. Closed duct fiber transport systems for transporting fibers from a distributor to a forming surface have been devised for that purpose and to largely prevent ambient air from entering the system and disturbing fiber transit to or deposition on a moving forming surface. An example of such a system is disclosed in U.S. Pat. No. 4,004,323.

There have been attempts to implement the closed fiber transport approach in those previously mentioned typical dry-forming systems wherein a stationary distributor feeds fibers downwardly onto a forming surface moving over a suction box. Various ambient air blocking means such as obturator rolls and flaps attached to upstream and downstream ends of distributors and extending down to the sides of the forming wire have been used to prevent fiber disruption due to turbulence from ambient air drawn into the suction box below the ends of the distributor and through the forming wire. In such systems, the rolls and flaps have been successful in blocking the ambient air but they have also largely prevented the creation, development or use of means for imparting a velocity component of movement to transiting fibers.

For those mentioned typical and other dry-forming systems, there has been a need for means for imparting to fibers a velocity component of movement in the direction of movement of the forming surface to improve the production, appearance and performance of dry-laid fibrous products. The device of this invention provides such means in the form of one or more air or gas turning foils situated adjacent the upstream end of and at the level of the region between a fiber distributor and suction box.

It is an object of this invention to provide means which will fulfill the aforementioned need.

It is an object of this invention to improve the production, production speed, cross sectional profile, appearance, characteristics and performance of dry-laid fibrous webs.

Another object is to provide in dry fibrous product forming systems, means for imparting a velocity component of movement in the direction of movement of the forming surface, to the material used to form the product while the material transits the region between a media distributor and the moving forming surface.

Another object is to also utilize the imparting means to simultaneously accelerate the movement of said material in said direction.

Another object is to provide the velocity component of movement to significantly improve fiber distribution and laydown onto the forming surface and to thereby significantly reduce clumping, lumping and/or striations in dry-laid fibrous webs formed at commercial speeds.

Another object of this invention is to meet the above objectives by providing ahead of the distributor at least one air turning foil having a terminal edge portion in or in an upstream extension of the region intermediate the distributor and forming surface, and in or near the upstream end of a fiber transit region between the distributor and forming surface.

Another object is to provide a plurality of said air-turning foils such that the magnitude of the velocity component imparted to substantially all fibers in transit through the upstream portion of the fiber transit region is substantially uniform.

BRIEF DESCRIPTION OF THE DRAWING

FIG. 1 is a side view, taken mostly in cross section, showing the device of this invention employed with a fiber distributor and a vertically offset suction box.

FIG. 2 is a top cross sectional view taken along line 2—2 of FIG. 1.

FIGS. 3 through 7 are side cross sectional views with portions broken away, respectively showing alternative embodiments of the device of this invention.

DETAILED DESCRIPTION OF THE INVENTION

Figure 4:
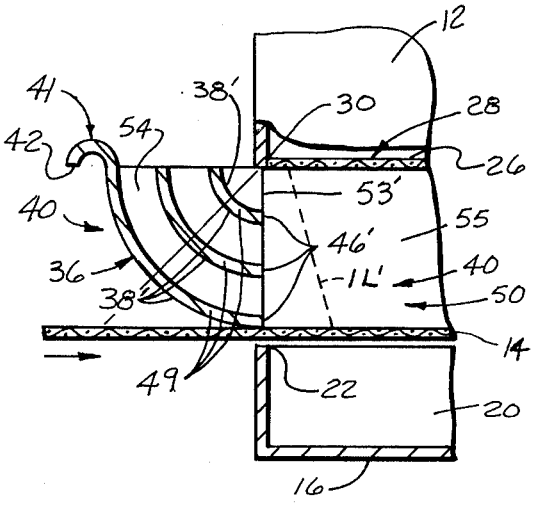

Referring to the drawings in detail, FIG. 1 shows apparatus for dry-laying fibers, filaments or particulate material or any combination thereof, hereinafter collectively termed fibers, onto a forming surface which moves the fibers to downstream apparatus (not shown) for further processing of the fibers into a dry-laid product, for example a web suitable for use as a wiper. More particularly, FIG. 1 shows an air-laying appratus, generally designated 10, comprised of a distributor 12, a forming surface, for example an endless foraminous forming screen or wire 14, and means for moving air, or an otherwise suitable gaseous medium, from the distributor to the forming surface, and comprising a suction box 16 positioned under the forming wire. In this embodiment, forming wire 14 is supported by and is driven substantially horizontally from left to right in the drawing, over rollers (not shown) by suitable driving means (also not shown). Relative to distributor 12, suction box 16 is offset in the direction of movement of the forming wire, and is connected by pipe 18 to means such as a motor-driven fan (not shown) for drawing fibers entrained in the air onto, and the air through, forming wire 14 and into the mouth 20 of suction box 16. Mouth 20 is defined by the mouth lip 22 which runs along the inner, uppermost edge of suction box housing wall 24.

Fibers are fed from storage means or from hammermills, lickering rolls or other suitable sources in a gaseous medium by conventional means (not shown) to one or more unconnected or interconnected conventional distributors, only one of which is shown at 12. The fibers, with or without the assistance of distributor internal rotors, horizontally rotating propellers, impellers, or other suitable sifting or distributing means (not shown), are spread out over and distributed through screen 26 covering distributor mouth 28. The mouth is defined by its lip 20 which runs along the inner, lower most edge of distributor housing wall 32. Fibers in transit or passing through the region 40, between distributor 12 and suction box 16, are drawn by the vacuum applied by the suction box onto forming wire 14 and collect thereon as a loose fiber continuum 34 which is carried by the forming wire under a sealing roll 35 positioned along or against the downstream end of distributor 12. Preferably, the roll is slightly spaced above the continuum to substantially seal the downstream end of the space between the distributor and forming wire, and thereby prevent downstream ambient air from being drawn back under the roll into the locale where the continuum is being formed and causing turbulence which might disrupt the path of the fibers as they move through region 40 toward the forming wire. Due to the offset relationship between distributor 12 and suction box 16, and due to the suction force effected from the suction box, fibers tend to move at an angle from the distributor toward the suction box. It is desired and thought that the fiber path should be angular relative to the forming wire to increase commercial operating speeds, and improve the cross sectional profile and overall appearance and performance of the continuum and resulting web product. The fiber path angle induced solely by the offset relationship and suction force exerted, however, can be and is made more acute and uniform, and forming speeds, web product cross sectional profile, performance, and appearance can be improved, by employing the device of this invention with conventional air-laying apparatus.

The device of this invention, generally designated 36, is comprised of at least one air turning foil 38, or as shown in FIG. 1, a plurality of foils 38, supported adjacent a distributor 12 by conventional means not shown. A foil 38 is positioned adjacent the upstream end of distributor 12 at the level of the region generally designated 40, between forming wire 14 and the underside of the distributor.

Region 40 has two sections, a downstream fiber transit section 50, through which fibers pass or transit from the distributor mouth to the suction box mouth, and an upstream section 52 within which device 36 is disposed. In FIG. 1, the upstream end of the transit section 50 roughly coincides with a substantially straight line defined by the upstream lip 30 of the distributor and the upstream lip 22 of the suction box. With respect to FIGS. 1 and 2, this line roughly corresponds to, and may be represented by, the downwardly angled downstream portion or edge 53 (FIG. 1) of foil side plate 54. In the embodiments shown herein, downstream section 50 is bounded along its length on each side by side deckles 55 which are attached to distributor 12 by means not shown, and extend down to or slightly above wire 14 to substantially seal the sides of the section 50 and prevent ambient air from being drawn into the section and causing fiber disruptive turbulence.

Referring temporarily to FIG. 3, each foil 38 of device 36 has an upstream terminal edge 42 and adjacent it an upstream terminal edge portion 44, and, a downstream terminal edge 46, and adjacent it, a downstream terminal edge portion 48 which points in the direction of movement of the forming wire. By such disposition, device 36 guides ambient air sucked by the suction box, from a region upstream of and adjacent to the distributor terminal edge portion, and directs this air in the direction of movement of the forming wire to impart to fibers in transit section 50, a velocity component of movement in said direction. The air-directed fibers thereby are given and take on a wire movement or machine direction component of velocity. These fibers are also thereby accelerated in the machine direction. Whem a plurality of foils is employed, and still with reference to FIG. 3, the outermost foil, that is, the one most removed from the distributor, as well as any used singularly, preferably has a terminal flange 41 between that foil's upstream terminal edge 42 and its upstream terminal edge portion 44. As shown, flange 41 preferably is arcuately shaped and extends outward in an upstream direction from terminal edge portion 44, to help air pass smoothly around the upper end of the foil and prevent any air flow separation which might tend to otherwise occur there, should a flange not be employed. The flange thereby permits the full effect of the suction generated at the suction box to be felt there and helps generate a good velocity profile in the channel or slot between the outermost foil and the next outermost foil in the case of a plurality of foils, and between the singular foil and the upstream corner of distributor wall 32 in the case of a device having a single foil.

Since the device of this invention smooths the passage of air sucked past the upstream corner of distributor wall 32 and prevents any air flow separation from occurring there the desired acute angle of the air flow and paths of transiting fibers advantageously is achieved.

FIG. 1 shows dotted lines L near the upstream end of transit section 50 which indicate in an exaggerated fashion the probable paths transiting fibers would take with the illustrated offset suction box configuration, if the fibers were not subjected to the effects of the device of this invention. As shown by lines L, upon a exiting distributor mouth 28, the fibers paths would initially be substantially vertical, then the paths would bend and take on an angular direction toward forming wire 14. The dashed lines L' in section 50 indicate probable paths transiting fibers take with a wire movement or machine velocity component of movement imparted to them by a preferred embodiment of the device of this invention as shown in FIG. 1. When such a preferred embodiment is employed, that is, a device having plurality of foils of an appropriate quantity, preferably three or more, whose downstream terminal edge portions 48 are equally spaced from and parallel to each other, parallel to forming wire 14, and point in the direction of movement of the forming wire, the air directed into section 50 is substantially uniform in terms of the amount and the velocity of the air directed from each foil into the section. Therefore, as characterized by the dashed lines L', at least with respect to those fibers transiting near the foils, their fiber path angle would not tend to differ much along the length of its acutely angled path to the forming wire.

FIG. 2, a top sectional view taken along line 2—2 of FIG. 1, clearly shows that foils 38 are parallel to and equally spaced from each other, run in the cross machine direction along the width of distributor 12, are bounded at their ends by respective end plates 54, and that the terminal edges 46 of each respective downwardly succeeding foil is offset in the direction of movement of forming wire 14, relative to the distributor upstream mouth edge 30. FIG. 2 also clearly shows side deckles 55 bounding each side of fiber continuum 34 on forming wire 14.

FIG. 3 is a side cross sectional view, with portions broken away, of an apparatus similar to that shown in FIG. 1, except that suction box 16 in FIG. 3 is not offset from but is vertically under distributor 12. More particularly, FIG. 3 shows that respective upstream mouth lips 30 and 22, of distributor 12 and suction box 16 are substantially vertically aligned. Though they need not be, and it is not fully shown, their respective downstream walls 32 and 24 are as shown in FIG. 1. FIG. 3 also shows that terminal edge portions 48 extend through an imaginary line (not shown) defined by respective distributor and suction box upstream mouth lips 30 and 22 and thereby create an offset effect somewhat comparable to that created by the offset orientation of the suction box shown in FIG. 1. Fibers in transit section 50 of the apparatus and device configurations shown in FIG. 3 would have an angular transit path (dashed lines L") less acute than the path indicated by the dashed lines L' in FIG. 1.

Figure 5:
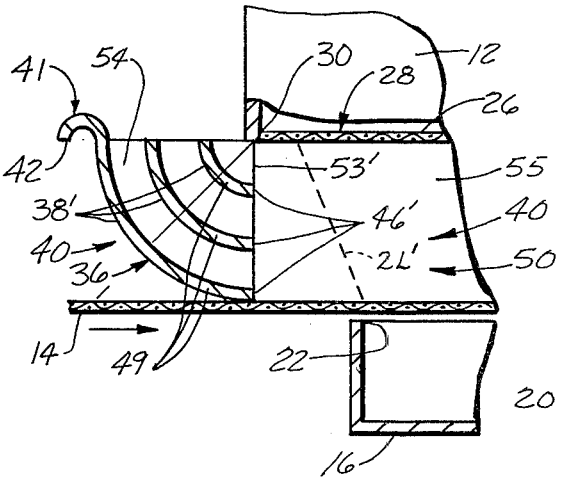

FIGS. 4 and 5 are side cross sectional views of apparatus similar to those shown in FIGS. 3 and 1 respectively, except that in FIGS. 4 and 5, device 36 includes foils 38' whose terminal edges 46' are in substantial vertical alignment with the upstream distributor slip 30 and the upstream suction box lip 22, in the case of FIG. 4. In the case of FIG. 5, edges 46' are vertically aligned with lip 30 only, since in FIG. 5 the suction box is horizontally offset in the downstream direction relative to distributor 12. In FIGS. 4 and 5, side plate edge 53' is substantially vertical. The angular path 1L' of fibers in the apparatus and device configurations shown in FIG. 5 would be less acute than that shown in FIG. 3, and the path 2L' shown in FIG. 4 less acute than that shown in FIG. 5.

Each device 36 can include any number foils of any suitable size, shape and configuration. Preferably a plurality of foils are employed whose size is complementary to pluality use, and, as nearly as possible, to uniform impartation of velocity components of movement from the top to the bottom of, and along the length of transit section 50. As shown in the drawings, the preferred foils are convexly curved upstream of the foil when viewed in cross section. The radius of curvature of any foil employed is preferably of a length less that of a straight line defined by and drawn from the upstream lip of the distributor mouth to a point on the forming wire in substantial vertical alignment with the upstream lip of the suction box mouth, in cases of aligned distributors and suction boxes as in FIGS. 3 and 4, or just vertically downward to the forming wire in cases of offset suction boxes as in FIGS. 1 and 5. Also, as shown in the drawings, preferably when a plurality of foils is employed, each foil has a radius of curvature shorter than that of the other, and each foil is concentrically positioned relative to the other in substantially equally spaced relationship relative to each other and the upstream end of the distributor. The foils shown in FIGS. 4 and 5 each have a convexly curved shape which resembles that of the lower left quadrant of a circle. For this configuration, preferably the radius of curvature of each foil extends from distributor's upstream mouth lip 30 downwardly to the left toward the forming wire to about the center of the length of the foil's arc, at an angle of about 45° relative to the forming wire. See for example radius R for the leftmost foil 36 in FIG. 1, and the dotted line extension thereof. In such cases, terminal edge portions 49 will direct air substantially parallel to the horizontally moving forming wire.

Figure 6:
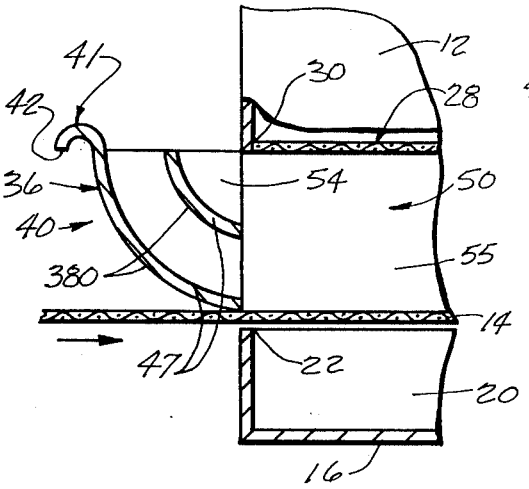

As is also shown in the drawings, when a plurality of foils are used, the terminal edge portion of the lowermost foil preferably is positioned as close to the forming wire as practically possible to prevent air from being drawn in under that foil and lifting fibers from or rolling them on the forming wire. FIG. 6 showss a device of this invention having two foils 380 whose terminal edge portions 47 point and direct air downwardly at an angle toward forming wire 14.

Figure 7:
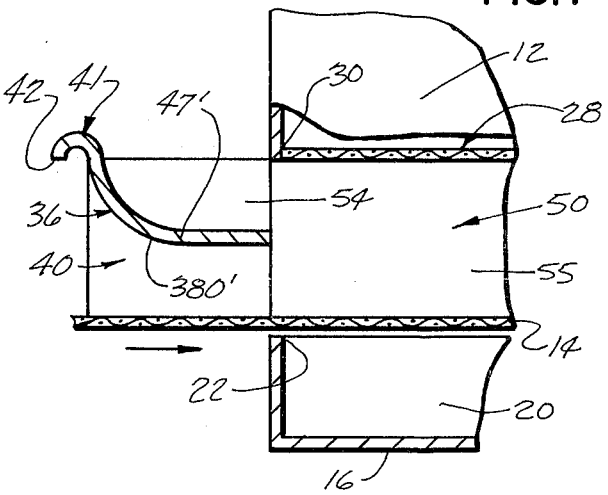

FIG. 7 shows a device 36 with one foil 380' preferably positioned such that its terminal edge portion 47' is substantially equidistant to the distributor 12 and suction box 16. Even so positioned, the fiber transit path would tend to be less consistent throughout its length than if more foils were employed.

Figure 8:
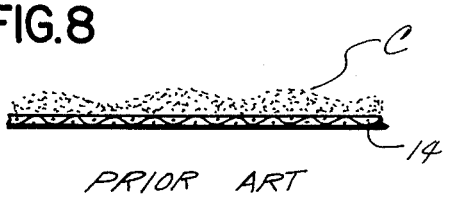
FIG. 8 is a side cross sectional view showing the profile of a portion of a web product dry-formed without a device of this invention.
Figure 9:
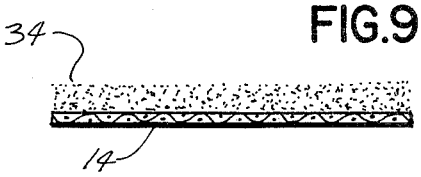
PRIOR ART FIG.9
FIG. 9 is a side cross sectional view showing the profile of a web product dry-formed with apparatus including a device of this invention.

FIG. 8 is a side cross sectional view as might be taken through a portion of a fibrous continuum C formed at a commercial production speed with a prior art apparatus without a device of this invention. Relative to a similar view in FIG. 9 of a continuum 34 formed at a commercial speed above 600 ft./min. with the help of a device of this invention, the upper surface of the prior art continuum is more undulating or rippled than that of continuum 34.

With respect to the velocity component of movement imparted by the devices of this invention, generally speaking, the more foils employed, the more uniform uniform the velocity imparted will be. By employing a device of this invention, the uniformity of the quantity or volume of air induced or introduced into transit section 50, and of the velocity components of movement imparted to transiting fibers in section 50, will be greater than if the upstream end of section 50 were left open. The quantity of air and velocity components the section would see, would be more uniform at points along the cross machine length of a foil's terminal edge than along an imaginary line drawn across the entrance to section 50 if no device or foil were employed.

The uniformity of air and of velocity components will be affected by several factors including the machine direction length of the fiber transit section, the suction force being drawn through and along the length of the forming wire and suction box and the relative positions of the distributor, suction box and foil terminal edges.

When a plurality of parallel equally spaced and angled foils is utilized, there would be overall substantial uniformity with respect to air volume introduced and of velocity components of movement imparted from a given foil of a device and through the space or slot between that foil and the foil above it, but there may not be overall substantial uniformity as to air volume or velocity components from each foil or slot of the same device. For example, the uniformity of air volume induced and velocity components imparted from slots between respective foils of a given device would be greater when the terminal edge of a device's lowermost foil is offset upstream from suction box upstream lip 22, as in FIG. 5, than when the device is so positioned that such edge is at the lip, as in FIG. 1, 4 and 6 or when the edge is offset downstream relative to the foil's other terminal edges and to the lip, as in FIG. 3.

The air or gas turning foils of the devices of this invention preferably are not of a shape which would permit dead spots in the flow of air or gas along the foils, for example as would tend to result at the angular junction of a foil formed by two flat terminal edge portions. Dead spots are undesirable because they tend to create turbulence in the air flow imparted from the foil.

The upstream terminal edges can extend upwardly beyond the upper limit of plane or zone 40 although such is not necessary. The foils are preferably of a thickness and made of a rigid material which will not permit their movement and the possible turbulence which might result therefrom. Although the devices of this invention preferably are employed with suction boxes in offset orientation relative to the distributor, the devices would provide advantageous results if used in dry-forming systems employing air moving means such as fans which blow rather than suck a gaseous medium downwardly at least through the device but desirably also through the distributor onto the forming wire, and in systems wherein the forming surface is arcuate as on a drum, or inclined or declined in the machine direction relative to the distributor and/or suction box.

It is thought that the invention and many of its attendant advantages will be understood from the foregoing description, and it is apparent that various changes may be made in the devices and structures described without departing from the spirit and scope of the invention or sacrificing all of its material advantages, the devices and structures hereinbefore described being merely preferred embodiments thereof.

We claim:

1. An apparatus for forming a continuous fibrous web of dry-laid fibers flowing in a gaseous medium from the mouth of a fiber distributor and onto a moving forming surface, comprising:

(a) a means for moving the fibers and gaseous medium to the forming surface; and (b) said apparatus comprising a foil positioned adjacent the upstream end of the distributor, at the level of the region between the mouth of the distributor and the forming surface, said foil having a downstream terminal edge and, adjacent the edge, a downstream terminal edge portion positioned above the forming surface and pointing in the direction of movement of the forming surface, solely for guiding ambient air induced by the moving means along the terminal edge portion and directing said air into said gaseous medium in the direction of movement of the moving surface, to impart to fibers moving between the mouth of the distributor and forming surface a velocity component of movement in said direction.

2. The apparatus of claim 1, wherein the forming surface is a foraminous forming wire and the moving means is a suction means which includes a suction box having a mouth which is in substantial alignment with the distributor mouth, for drawing the gaseous medium through the forming wire.

3. The apparatus of claim 1, wherein the forming surface is a foraminous forming wire and the moving means is suction means which includes a suction box having a mouth which is offset in the direction of movement of the forming wire relative to the distributor mouth, for drawing the gaseous medium through the forming wire.

4. The apparatus of claim 2 or 3, wherein the distributor and suction box each have a lip which defines their respective mouths, and wherein the terminal edge is in substantial alignment with a substantially straight line defined by the upstream lip of the distributor and the upstream lip of the suction box.

5. The apparatus of claim 2 or 3, wherein the distributor and suction box each have a lip which defines their respective mouths, and wherein the terminal edge is offset in the direction of movement of the forming wire relative to the upstream lip of the distributor.

6. The apparatus of claim 5, wherein the terminal edge is substantially aligned with the upstream lip of the suction box.

7. The apparatus of claim 1 wherein the foil is convexly curved upstream of the foil when viewed in cross section.

8. The apparatus of claim 2 wherein the foil is convexly curved upstream of the foil when viewed in cross section, and wherein the radius of curvature of the foil has a length less than that of a straight line defined by the upstream lip of the distributor and a point on the forming wire in substantial alignment with the upstream lip of the suction box.

9. The apparatus of claim 1, 2, 3, 7 or 8, wherein the shape of the foil when viewed in cross section resembles that of the lower left quadrant of a circle.

10. The apparatus of claim 8, wherein the forming wire moves substantially horizontally under the distributor and above the suction box, and a radius extending in an upstream direction from the upstream distributor lip downwardly toward the forming wire, to about the center of length of the foil's arc, forms an angle of about 45° relative to the forming wire.

11. The apparatus of claim 1, 2, 3, 7 or 8, wherein the terminal edge portion is substantially parallel to the forming surface.

12. The apparatus of claim 1, 2, 3, 7 or 8, wherein the terminal edge portion lies at an angle which points toward the forming surface.

13. The apparatus of claim 7, wherein the foil is proximate the forming wire, and including a second foil interposed between the proximate foil and the distributor and having a radius of curvature shorter than that of the proximate foil.

14. An apparatus for forming a continuous fibrous web of dry-laid fibers flowing in a gaseous medium from the mouth of a fiber distributor and onto a moving forming surface, comprising:

(a) means for moving the fibers and gaseous medium to the forming surface; and (b) said apparatus comprising a plurality of foils positioned adjacent the upstream end of the distributor, at the level of the region between the distributor and the forming surface, each of said foils having a downstream terminal edge and, adjacent the edge, a downstream terminal edge portion pointing in the direction of movement of the forming surface, solely for guiding ambient air moved by the moving means along the terminal edge portion and directing said air into said gaseous medium in the direction of movement of the forming surface, to impart to fibers in transit between the distributor and forming surface a velocity component of movement in said direction.

15. The apparatus of claim 14, wherein the forming surface is a foraminous forming wire and the moving means is a suction means which includes a suction box having a mouth which is in substantial alignment with the distributor mouth, for drawing the gaseous medium through the forming wire.

16. The apparatus of claim 14, wherein the forming surface is a foraminous forming wire and the moving means is a suction means which includes a suction box having a mouth which is offset in the direction of movement of the forming wire relative to the distributor mouth, for drawing the gaseous medium through the forming wire.

17. The apparatus of claim 15, wherein the distributor and suction box each have a lip which defines their respective mouths, and wherein each terminal edge is in approximate alignment with a substantially straight line extending from the upstream distributor lip toward the forming surface.

18. The apparatus of claim 15 or 16, wherein the distributor and suction box each have a lip which defines their respective mouths, and wherein each terminal edge is in substantial alignment with a substantially straight line defined by the upstream lip of the distributor and the upstream lip of the suction box.

19. The apparatus of claim 15 or 16, wherein the distributor and suction box each have a lip which defines their respective mouths, and wherein each terminal edge is offset relative to the other in the direction of movement of the forming wire and relative to the upstream lip of the distributor.

20. The apparatus of claim 19, wherein the terminal edges are substantially aligned with the upstream lip of the suction box.

21. The apparatus of claim 14, wherein each of the foils is convexly curved upstream of the foil when viewed in across section 22. The apparatus of claim 14, wherein each terminal edge portion is parallel to and equally spaced from the other, for directing ambient air uniformly against the flowing fibers to impart to them a substantially uniform velocity component of movement in the direction of movement of the forming surface.

23. The apparatus of claim 14 wherein each foil is convexly curved upstream of the foil when viewed in cross section and is concentrically positioned in a substantially equally spaced relationship relative to the other, for directing ambient air uniformly agains the flowing fibers to impart to them a substantially uniform velocity component of movement in the direction of movement of the forming surface.

24. The apparatus of claim 21, wherein the distributor and suction box each have a lip defines their respective mouths, and wherein each foil has a radius of curvature shorter than that of the other, and of a length less than the straight line distance from the upstream distributor lip to a point on the forming wire in substantial alignment with the upstream lip of the suction box.

25. The device of claim 21, 23 or 24 wherein the shape of each foil when viewed in cross section resembles that of the lower left quadrant of a circle.

26. The apparatus of claim 24, wherein the forming wire moves substantially horizontally under the distributor and above the suction box, and the radius of curvature of each foil extends in an upstream direction from the upstream distributor lip downward toward the forming wire to about the center of length of the foil's arc, at an angle of about 45° relative to the forming wire.

27. The device of claim 14, 15, 16, 17, 22 or 23, wherein each terminal edge portion is substantially parallel to the forming surface.

28. The device of claim 14, 15, 16, 17, 22 or 23, wherein each terminal edge portion lies at an angle which points toward the forming surface.

* * * * *